US007975361B2

(12) United States Patent
Takishita

(10) Patent No.: US 7,975,361 B2
(45) Date of Patent: Jul. 12, 2011

(54) AFTER-TREATMENT METHOD AND FACILITY FOR A COARSE ALUMINUM CASTING

(75) Inventor: Koji Takishita, Toyokawa (JP)

(73) Assignee: Sintokogio, Ltd., Aichi-Ken (JP)

( * ) Notice: Subject to any disclaimer, the term of this patent is extended or adjusted under 35 U.S.C. 154(b) by 1204 days.

(21) Appl. No.: 11/631,116

(22) PCT Filed: Jun. 29, 2005

(86) PCT No.: PCT/JP2005/011972

§ 371 (c)(1),
(2), (4) Date: Dec. 29, 2006

(87) PCT Pub. No.: WO2006/003947

PCT Pub. Date: Jan. 12, 2006

(65) Prior Publication Data

US 2009/0193954 A1 Aug. 6, 2009

(30) Foreign Application Priority Data

Jul. 2, 2004 (JP) ..... 2004-197098

(51) Int. Cl.
*B23Q 7/00* (2006.01)

(52) U.S. Cl. ..... 29/559; 901/31; 901/39

(58) Field of Classification Search ..... 29/559; 901/31, 39
See application file for complete search history.

(56) References Cited

U.S. PATENT DOCUMENTS

| | | | | | |
|---|---|---|---|---|---|
| 2,792,953 | A | * | 5/1957 | Mayer | 414/728 |
| 3,968,885 | A | * | 7/1976 | Hassan et al. | 414/591 |
| 4,307,891 | A | * | 12/1981 | Doornick et al. | 280/1.22 |
| 4,655,676 | A | * | 4/1987 | Jannborg et al. | 414/736 |
| 5,022,636 | A | | 6/1991 | Swann | |
| 5,471,738 | A | * | 12/1995 | Burcham et al. | 29/701 |
| 5,570,920 | A | * | 11/1996 | Crisman et al. | 294/111 |

FOREIGN PATENT DOCUMENTS

| | | | | |
|---|---|---|---|---|
| EP | 0620064 | A1 | | 10/1994 |
| JP | 59152038 | A | * | 8/1984 |
| JP | 06-163493 | | | 6/1994 |
| JP | 06344118 | A | | 12/1994 |
| JP | 2002-151565 | | | 5/2002 |
| JP | 2002-184839 | | | 6/2002 |

* cited by examiner

*Primary Examiner* — Jermie E Cozart
(74) *Attorney, Agent, or Firm* — Finnegan, Henderson, Farabow, Garrett & Dunner, L.L.P.

(57) ABSTRACT

A robot holds an untreated coarse aluminum casting that is located at a predetermined carrying-in corner with the holding means and carries it to the first machining unit. At the first unit it holds a treated casting treated by the first unit with the holding device as well as transferring the untreated casting from the holding device to the first unit. Then it carries the treated casting that has been treated by the first unit to a second machining unit. At the second unit it holds a second treated casting that has been treated by the second unit with the holding device as well as transferring the treated casting treated by the first unit from the holding device to the second unit. Then it carries the second treated casting treated by the second unit to a predetermined carrying-out corner.

2 Claims, 3 Drawing Sheets

AFTER-TREATMENT METHOD AND FACILITY FOR A COARSE ALUMINUM CASTING

FIELD OF THE INVENTION

The present invention relates to an after-treatment method and facility for coarse aluminum castings. More particularly, it relates to a method and facility wherein a robot having a holding means that can hold two coarse aluminum castings carries the coarse aluminum castings one by one to a first and a second machining unit that carry out the after-treatment of them, at the time they are carried out by a cellular manufacturing system.

BACKGROUND OF THE INVENTION

One of the existing methods that continuously carries out after-treatments of coarse aluminum castings that have been taken out of a casting machine is one in which a first and a second machining unit are placed side by side, and one robot carries one by one the coarse aluminum castings to the first and the second machining unit and takes them out one by one.

However, according to the existing method of after-treatment for coarse aluminum castings as constructed above, the robot cannot efficiently hold and carry them to the first and the second machining unit.

SUMMARY OF THE INVENTION

The problem to be resolved is that the one robot cannot efficiently hold and pass coarse aluminum castings to two units, i.e., a first and a second machining unit.

In order to resolve this problem, the method of carrying out the after-treatment for coarse aluminum castings of the present invention is one in which a robot having a holding means that can hold two coarse aluminum castings carries each one one by one to the first and the second machining unit that carry out the after-treatment for them, during the period that the after-treatment is continuously carried out by a cellular manufacturing system. It comprises holding an untreated coarse aluminum casting that is located at a predetermined carrying-in corner with the holding means and by the robot carrying it to the first machining unit, at the first machining unit holding a treated coarse aluminum casting that has been treated by the first machining unit with the holding means as well as transferring the untreated coarse aluminum casting from the holding means to the first machining unit, by the robot carrying the treated coarse aluminum casting that has been treated by the first machining unit to the second machining unit, at the second machining unit holding a treated coarse aluminum casting that has been treated by the second machining unit with the holding means as well as transferring the treated coarse aluminum casting that has been treated by the first machining unit from the holding means to the second machining unit, and by the robot carrying the treated coarse aluminum casting that has been treated by the second machining unit to a predetermined carrying-out corner.

In the present invention, the term "after-treatment" means carrying out at least one of the processes of cutting, trimming, and drilling at least one of a portion near a sprue, an overflowing portion, flashes, and a surface (surface processing) of a coarse aluminum casting.

Further, the term "machining unit" means a unit that carries out at least one of the processes of cutting, trimming, and drilling at least one of a portion near a sprue, an overflowing portion, flashes, and a surface (surface processing) of a coarse aluminum casting. The main parts of the machining unit are an overflow-breaking unit that breaks or cuts an overflowing portion of a coarse aluminum casting, a sprue-gate cutting unit that cuts the portion near a sprue-gate of a coarse aluminum casting, a surface-finishing unit that carries out a surface-finishing of a coarse aluminum casting, a flash-eliminating unit that eliminates flashes of a coarse aluminum casting, a surface-processing unit that carries out the surface-processing of a coarse aluminum casting, etc.

The term "surface processing of a coarse aluminum casting" means the process that must be done before carrying out some post-processes such as various tests to be done after the after-treatment so as to produce an aluminum casting having no defect.

As discussed above, the present invention is a method of carrying out the after-treatment for coarse aluminum castings that are continuously carried out by a cellular manufacturing system (a manufacturing system carried out at stalls), wherein a robot having a holding means that can hold two coarse aluminum castings carries, one by one, each of the coarse aluminum castings to the first and the second machining unit that carry out the after-treatment for them. The method comprises holding an untreated coarse aluminum casting that is located at a predetermined carrying-in corner with the holding means and by the robot carrying it to the first machining unit, at the first machining unit holding a treated coarse aluminum casting that has been treated by the first machining unit with the holding means as well as transferring the untreated coarse aluminum casting from the holding means to the first machining unit, carrying the treated coarse aluminum casting that has been treated by the first machining unit to the second machining unit by the robot, at the second machining unit holding a treated coarse aluminum casting that has been treated by the second machining unit with the holding means as well as transferring the treated coarse aluminum casting that has been treated by the first machining unit from the holding means to the second machining unit, and by the robot carrying the treated coarse aluminum casting that has been treated by the second machining unit to a predetermined carrying-out corner.

Accordingly, the robot can carry the coarse aluminum casting of which the after-treatment has already been done by the first machining unit to the second machining unit while the first machining unit is carrying out the after-treatment of an untreated coarse aluminum casting. The robot can also carry an untreated coarse aluminum casting to the first machining unit while the second machining unit is carrying out the after-treatment of the treated coarse aluminum casting that has been treated by the first machining unit. Therefore, the invention can achieve an excellent effect in that it can more efficiently operate a machining unit than can a conventional method of this kind of after-treatment.

BRIEF DESCRIPTIONS OF THE DRAWINGS

BEST MODE FOR CARRYING OUT THE INVENTION

Figure 1:
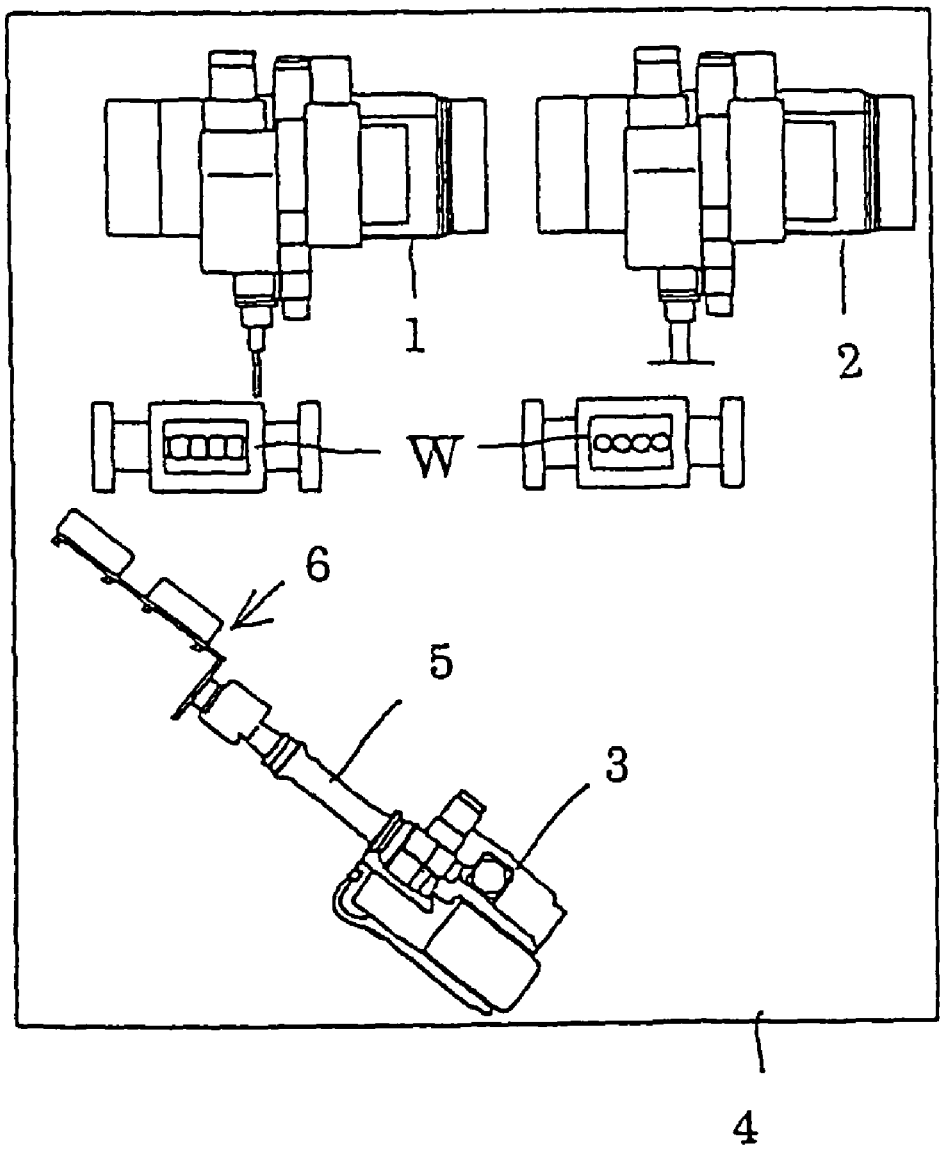
FIG. 1 is a plan view showing the after-treatment facility of the best mode of the present invention.
Figure 2:
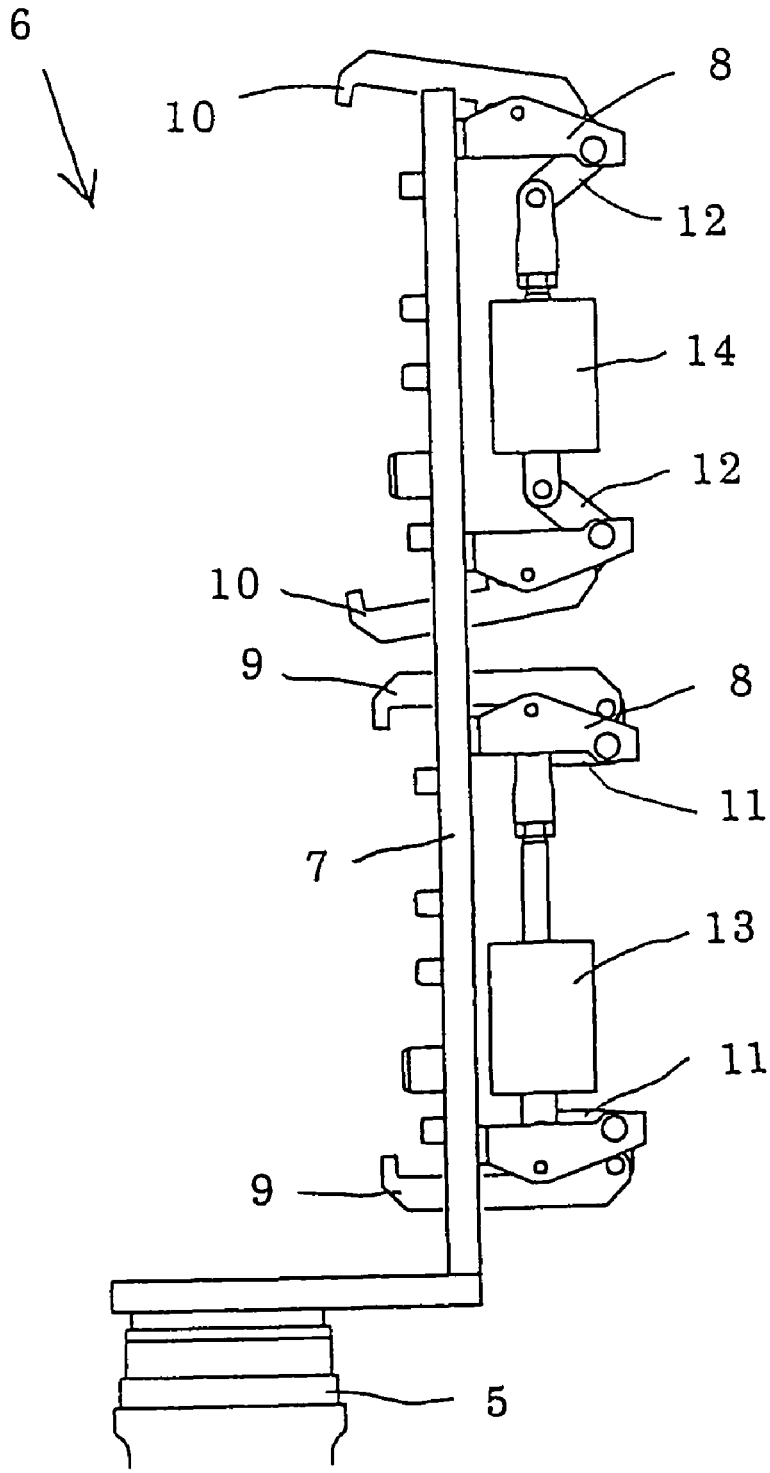
FIG. 2 is an enlarged detail of a principal part (holding means 6) of FIG. 1.
Figure 3:
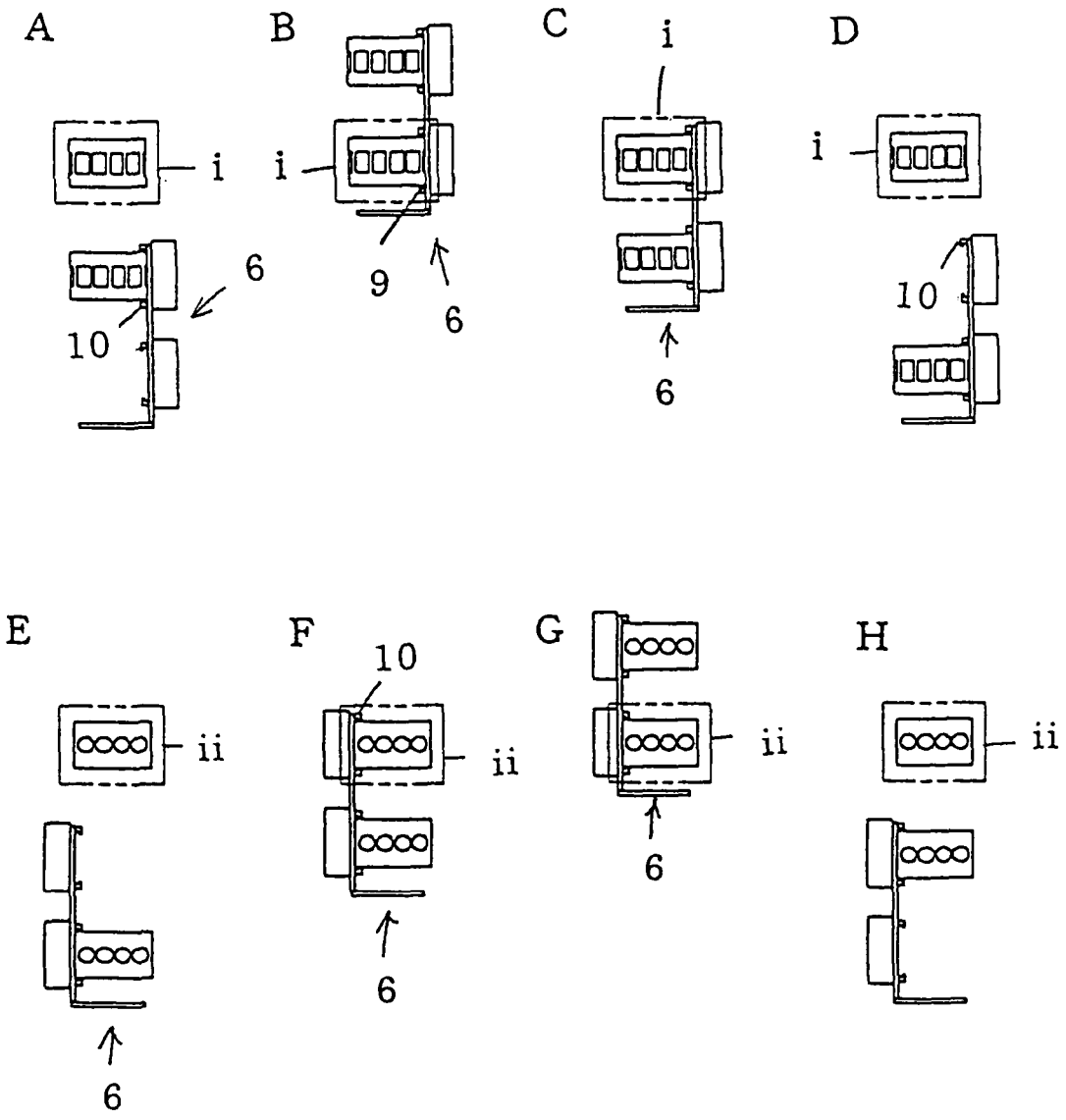
FIG. 3 is an explanatory drawing of the movement of a principal part (holding means 6) of FIG. 1.

Now we discuss the details of the after-treatment facility of the best mode of the present invention, based on FIGS. 1-3. As shown in FIG. 1, the after-treatment facility for coarse aluminum castings comprises a sprue-gate cutting unit 1 (hereafter, machining unit I) that cuts a portion near a sprue-gate of a coarse aluminum casting (W) of a straight four-cylinder block of an automobile, an overflow-breaking unit 2 (hereafter, machining unit II) that breaks overflowing portions of the coarse aluminum casting (W), and a robot 3 that is installed adjacent to these machining units I and II and that holds the coarse aluminum casting (W) and carries it to the machining units I and II. These machining units I and II are installed on a machine platen.

The robot 3 (FANUCS-430iF, made by FANUC Ltd.) has multiple joints with six axes. The control for turning an arm 5 of the robot 3 is performed by the program that is stored in the controller (not shown), wherein the program is made by "teaching" in advance. A holding mechanism 6 for a coarse aluminum casting (W) is mounted on the arm 5 of the robot 3 so as to hold two of the coarse aluminum castings. As shown in FIG. 2, it comprises a supporting member 7 that is mounted on the end of the arm 5 and that extends in its longitudinal direction, and two pairs of claw-parts 9, 9, 10, 10 that are installed in two pairs of brackets 8, 8. They are rotatable around the supporting member 7. Two pairs of L-shaped links 11, 11, 12, 12 are rotatably jointed by pins at the ends of the claw-parts 9, 9, 10, 10 and pivoted at the crooks of the brackets 8, 8. Two cylinders 13, 14 are mounted between the ends of each pair of the links 11, 11, 12, 12 by pins. The two pairs of claw-parts 9, 9, 10, 10 can be opened and closed by the expansion and contraction of the cylinders 13, 14.

Based on FIG. 3, we now discuss the procedure that carries out the after-treatment of the coarse aluminum castings. This procedure is continuously carried out by a cellular manufacturing system, wherein the robot 3 carries the coarse aluminum castings one by one to each of the machining units I and II that cuts and/or trims the portion located close to the sprue and/or the flashes of the coarse aluminum casting. As shown in FIG. 3-A, a treated coarse aluminum casting (hereafter, treated work) that has been treated by the machining unit I is located on a setting table (i), and an untreated coarse aluminum casting (hereafter, untreated work) is held with the pair of claw-parts 10, 10 of the holding means 6. In this state of things, as shown in FIG. 3-B, the holding means 6 that holds the untreated work moves and causes the vacant pair of claw-parts 9, 9 to be located on a setting table (i) so that it can grasp the treated work that has been treated by the machining unit I.

Then, after getting the pair of claw-parts 9, 9 to hold the treated work that has been treated by the machining unit I and that has been located on the setting table (i), the holding means 6 moves and removes the treated work that has been treated by the machining unit I from the setting table (i) as well as bringing the untreated work to the setting table (i), as shown in FIG. 3-C. Next, as shown in FIG. 3-D, the holding means 6 opens the pair of claw-parts 10, 10 to put the untreated work on the setting table (i). After that, the machining unit I processes the untreated work on the setting table (i). Then, as shown in FIG. 3-E, the holding means 6 is rotated by 180 degrees around the axis of the arm 5 and causes the treated work that has been treated by the machining unit I to be reversed. The holding means 6 that holds the treated work that has been treated by the machining unit I also moves to a setting table (ii) of the machining unit II on which the treated work has been treated by the machining unit II.

By rotating the treated work by 180 degrees with the holding means 6, the portion of the treated work on which the after-treatment is to be carried out is changed.

Next, as shown in FIG. 3-F, a holding means 6 that holds the treated work that has been treated by the machining unit I moves and positions the vacant pair of claw-parts 10, 10 on the setting table (ii) so as hold the treated work that has been treated by the machining unit II. Then, it grasps the treated work that has been treated by the machining unit II and that is located on the setting table (ii) by closing the pair of claw-parts 10, 10. Next, as shown in FIG. 3-G, the holding means 6 moves and removes the treated work that has been treated by the machining unit II from the setting table (ii) as well as brings the treated work that has been treated by the machining unit I to the setting table (ii). Then, as shown in FIG. 3-H, the holding means 6 opens the pair of claw-parts 9, 9 to put the treated work that has been treated by the machining unit I on the setting table (ii). After that, the holding means 6 that holds the treated work that has been treated by the machining unit II moves to the predetermined position at a carrying-out corner. Then, the machining unit II processes the treated work that has been treated by the machining unit I and that is located on the setting table (ii).

What is claimed:

1. A method of carrying out after-treatment of coarse aluminum castings that are continuously carried out by a cellular manufacturing system, wherein a robot having a holding means that can hold two coarse aluminum castings carries each of the coarse aluminum castings one by one to first and second machining units that carry out an after-treatment on the coarse aluminum castings, the method, comprising holding an untreated coarse aluminum casting that is located at a predetermined position of a carrying-in corner with a holding means that can hold two coarse aluminum castings at the same time and carrying an untreated coarse aluminum casting to the first machining unit by the robot, holding and removing a first treated coarse aluminum casting that has been treated by the first machining unit with the holding means as well as transferring the untreated coarse aluminum casting from the holding means to the first machining unit, carrying the first treated coarse aluminum casting that has been treated by and removed from the first machining unit to the second machining unit by the robot, holding and removing a second treated coarse aluminum casting that has been treated by the second machining unit with the holding means as well as transferring the first treated coarse aluminum casting that has been treated by the first machining unit from the holding means to the second machining unit, and carrying the second treated coarse aluminum casting that has been treated by and removed from the second machining unit to a predetermined position at a carrying-out corner by the robot.

2. The method of carrying out after-treatment of coarse aluminum castings of claim 1, wherein the first treated coarse aluminum casting is rotated by 180 degrees during the process of the robot carrying the first treated coarse aluminum casting that has been treated by the first machining unit to the second machining unit.

* * * * *